US011169466B2

(12) United States Patent
Takeda

(10) Patent No.: US 11,169,466 B2
(45) Date of Patent: Nov. 9, 2021

(54) IMAGE FORMING APPARATUS WITH PROCESS BIAS SETTING

(71) Applicant: TOSHIBA TEC KABUSHIKI KAISHA, Tokyo (JP)

(72) Inventor: Yuichiro Takeda, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/989,978

(22) Filed: Aug. 11, 2020

(65) Prior Publication Data

US 2021/0294242 A1 Sep. 23, 2021

(30) Foreign Application Priority Data

Mar. 23, 2020 (JP) ..... JP2020-051923

(51) Int. Cl.
*G03G 15/08* (2006.01)
*G03G 15/00* (2006.01)
*G03G 15/01* (2006.01)

(52) U.S. Cl.
CPC ..... *G03G 15/0855* (2013.01); *G03G 15/0126* (2013.01); *G03G 15/5041* (2013.01); *G03G 2215/0891* (2013.01)

(58) Field of Classification Search
CPC ..... G03G 15/0855; G03G 15/0126; G03G 15/5041; G03G 2215/0891; G03G 15/0865; G03G 15/065; G03G 15/0266
See application file for complete search history.

(56) References Cited

U.S. PATENT DOCUMENTS 6,311,025 B1 * 10/2001 Nagata ..... G03G 15/0865 399/12
2010/0290791 A1 * 11/2010 Sonoda ..... G03G 15/55 399/12

(Continued)

FOREIGN PATENT DOCUMENTS

JP 2016-099366 5/2016
JP 2016-212302 12/2016

*Primary Examiner* — Sandra Brase
(74) *Attorney, Agent, or Firm* — Amin, Turocy & Watson, LLP

(57) ABSTRACT

According to one embodiment, an image forming apparatus includes: an image forming unit configured to form a toner image using a first toner supplied to the image forming unit with a first process bias VR; a density sensor configured to detect a density of toner in the image forming unit; a toner cartridge containing a second toner and including a memory that stores data representing a process bias VA appropriate for the second toner; a mounting unit on which the toner cartridge is mounted; and a toner replenishing unit configured to replenish the image forming unit with the second toner from the toner cartridge mounted on the mounting unit based on the density, in which a density detected by the density sensor when the toner cartridge is mounted on the mounting unit is converted into an estimated amount, and the image forming unit is set to a process bias V until the image forming unit is replenished with the second toner by the estimated amount after the toner cartridge is mounted on the mounting unit, the process bias V being obtained from the following formula V=VA−((VA−VR)/the estimated amount)×(an amount of the second toner with which the image forming unit is replenished after the toner cartridge is mounted on the mounting unit).

16 Claims, 3 Drawing Sheets

(56) References Cited

U.S. PATENT DOCUMENTS

| | | | |
|---|---|---|---|
| 2011/0229156 | A1 | 9/2011 | Ohkawa et al. |
| 2016/0147174 | A1 | 5/2016 | Yasuda et al. |

* cited by examiner

IMAGE FORMING APPARATUS WITH PROCESS BIAS SETTING

CROSS-REFERENCE TO RELATED APPLICATION

This application is based upon and claims the benefit of priority from Japanese Patent Application No. 2020-051923, filed Mar. 23, 2020, the entire contents of which are incorporated herein by reference.

FIELD

Embodiments described herein relate generally to an image forming apparatus and related methods.

BACKGROUND

An image forming apparatus includes a developing unit that receives toner from a toner cartridge and forms a toner image on a photosensitive drum.

In a general configuration, a toner cartridge in which the toner is supplied to the developing unit and the amount of toner is reduced can be replaced with another toner cartridge containing a large amount of toner.

Properties of the toner remaining in the developing unit may be largely different from the properties of the toner in the newly replaced toner cartridge.

During the toner cartridge replacement, there is a problem in that the image quality of the toner image may changes abruptly before and after the replacement.

DETAILED DESCRIPTION

According to embodiments, it is desirable to avoid an abrupt large change in the image quality of a toner image before and after replacement even when a toner cartridge is replaced.

In general, according to one embodiment, there is provided an image forming apparatus including: an image forming unit configured to form a toner image using a first toner supplied to the image forming unit with a first process bias VR; a density sensor configured to detect a density of toner in the image forming unit; a toner cartridge containing a second toner and including a memory that stores data representing a process bias VA appropriate for the second toner; a mounting unit on which the toner cartridge is mounted; a toner replenishing unit configured to replenish the image forming unit with the second toner from the toner cartridge mounted on the mounting unit based on the density; and a processor configured to convert a density detected by the density sensor when the toner cartridge is mounted on the mounting unit into an estimated amount and configured to set the image forming unit to a process bias V until the image forming unit is replenished with the second toner by the estimated amount after the toner cartridge is mounted on the mounting unit, the process bias V being obtained from the following formula V=VA−((VA−VR)/the estimated amount)×(an amount of the second toner with which the image forming unit is replenished after the toner cartridge is mounted on the mounting unit). According to another embodiment, a method involves forming a toner image using a first toner supplied to an image forming component with a first process bias VR; detecting a density of toner in the image forming component using a density sensor; replenishing the image forming component with a second toner from a toner cartridge mounted on a mounting structure based on the density, the second toner having a process bias VA associated therewith; convert a density detected by the density sensor when the toner cartridge is mounted on the mounting unit into an estimated amount; and setting the image forming component to a process bias V until the image forming component is replenished with the second toner by the estimated amount after the toner cartridge is mounted on the mounting structure, the process bias V obtained from formula: V=VA−((VA−VR)/the estimated amount)×(an amount of the second toner with which the image forming component is replenished after the toner cartridge is mounted on the mounting structure).

Figure 1:
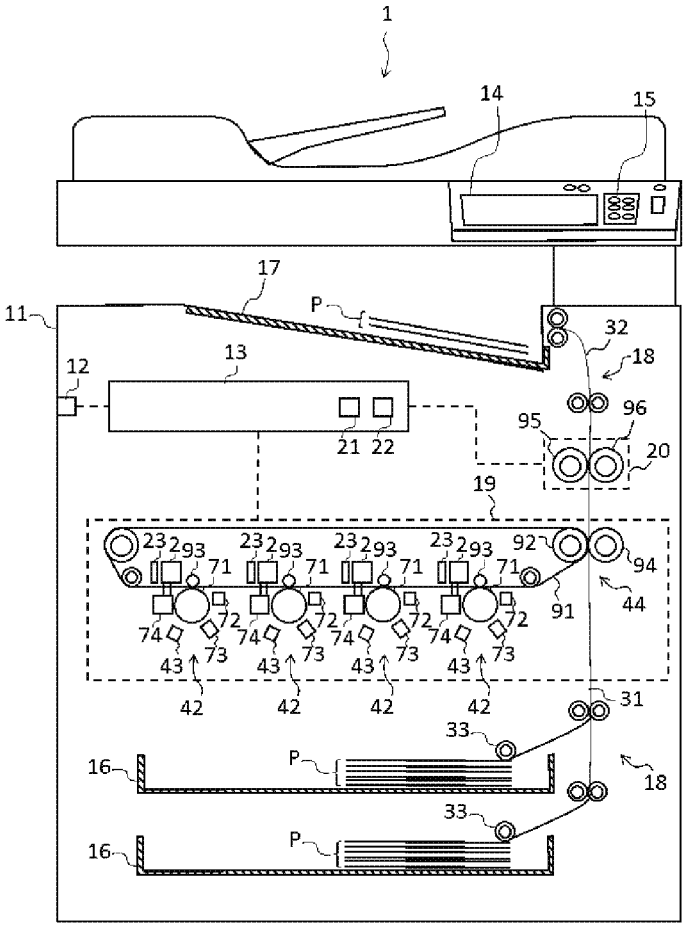
FIG. 1 is a diagram illustrating a configuration example of an image forming apparatus according to one embodiment.

Hereinafter, an image forming apparatus according to an embodiment and a control method of the image forming apparatus will be described with reference to the drawings. FIG. 1 is a diagram illustrating a configuration example of an image forming apparatus 1 according to the embodiment.

The image forming apparatus 1 is, for example, a multi-function printer (MFP) that executes various processes such as an image forming process while conveying a recording medium such as a printing medium. The image forming apparatus 1 is, for example, a solid-state scanning type printer (for example, an LED printer) that scans an LED array to execute various processes such as an image forming process while conveying a recording medium such as a printing medium.

For example, the image forming apparatus 1 is configured to receive toner from the toner cartridge 2 and to form an image on a printing medium using the received toner. The toner may be a monochrome toner or may be a toner of a color such as cyan, magenta, yellow or black.

As illustrated in FIG. 1, the image forming apparatus 1 includes a housing 11, a communication interface 12, a system controller 13, a display unit 14, an operation interface 15, a plurality of paper trays 16, a paper discharge tray 17, a conveying unit 18, an image forming unit 19, and a fixing unit 20.

The housing 11 is a main body of the image forming apparatus 1. The housing 11 houses the communication interface 12, the system controller 13, the display unit 14, the operation interface 15, the paper trays 16, the paper discharge tray 17, the conveying unit 18, the image forming unit 19, and the fixing unit 20.

The communication interface 12 is an interface for communication with another apparatus. The communication interface 12 is used for communication with, for example, a higher-level apparatus (external apparatus). The communication interface 12 is configured as, for example, a LAN connector. The communication interface 12 may execute wireless communication with another apparatus according to various communication standards.

The system controller 13 controls the image forming apparatus 1. The system controller 13 includes, for example, a processor 21 and a memory 22.

The processor 21 is an arithmetic element that executes arithmetic processing. The processor 21 is, for example, a CPU. The processor 21 executes various processes based on data such as programs stored in the memory 22. The processor 21 functions as a control unit that can execute various operations by executing the programs stored in the memory 22.

The memory 22 is a storage medium that stores the programs and the data used in the programs. The memory 22 also functions as a working memory. That is, the memory 22 temporarily stores, for example, data that is being processed by the processor 21 and the programs that is executed by the processor 21.

The processor 21 executes various information processing by executing the programs stored in the memory 22. For example, the processor 21 generates a print job based on an image acquired from an external apparatus via the communication interface 12. The processor 21 stores the generated print job in the memory 22.

The print job includes image data representing an image that is formed on a printing medium P. The image data may be data for forming an image on a single printing medium. P or may be data for forming an image on a plurality of printing media P. The print job includes information representing whether the printing is color printing or monochrome printing.

The processor 21 controls operations of the conveying unit 18, the image forming unit 19, and the fixing unit 20 by executing the programs stored in the memory 22. The processor 21 controls the conveyance of the printing medium P by the conveying unit 18, the formation of an image on the printing medium P by the image forming unit 19, the fixing of an image on the printing medium P by the fixing unit 20, and the like.

The display unit 14 includes a display that displays a screen according to a video signal input from the system controller 13. For example, the display of the display unit 14 displays a screen for various settings of the image forming apparatus 1, information regarding the remaining amount of toner, and the like.

The operation interface 15 is connected to an operation member (not illustrated). The operation interface 15 supplies an operation signal corresponding to the operation of the operation member to the system controller 13. The operation member is, for example, a touch sensor, a numeric keypad, a power key, a paper feed key, various function keys, or a keyboard. The touch sensor acquires information representing a position designated in a region. The touch sensor is configured as a touch panel integrated with the display unit 14 such that a signal representing a position that is touched on a screen displayed by the display unit 14 is input to the system controller 13.

The paper trays 16 are cassettes accommodating the printing media P, respectively. The paper tray 16 is configured to supply the printing medium P from the outside of the housing 11. For example, the paper tray 16 is configured to be drawn out from the housing 11. The paper discharge tray 17 is a tray that supports the printing medium P discharged from the image forming apparatus 1.

The conveying unit 18 is a mechanism that conveys the printing medium P in the image forming apparatus 1. As illustrated in FIG. 1, the conveying unit 18 includes a plurality of conveyance paths. For example, the conveying unit 18 includes a paper feed conveyance path 31 and a paper discharge conveyance path 32.

The paper feed conveyance path 31 and the paper discharge conveyance path 32 are configured with a plurality of motors, a plurality of rollers, and a plurality of guides (all of which are not illustrated). The motors rotate the rollers that operate together with axial rotation based on a control of the system controller 13. The rollers rotate to move printing medium P. The guides control a conveying direction of the printing medium P.

The paper feed conveyance path 31 picks up the printing medium P from the paper tray 16 and supplies the picked printing medium P to the image forming unit 19. The paper feed conveyance path 31 includes a pickup roller 33 corresponding to each of the paper trays. Each of the pickup rollers 33 picks up the printing medium P of the paper tray 16 to the paper feed conveyance path 31. The paper discharge conveyance path 32 is a conveyance path through which the printing medium P on which an image is formed is discharged from the housing 11. The printing medium P discharged through the paper discharge conveyance path 32 is supported by the paper discharge tray 17.

The image forming unit 19 is configured to form an image on the printing medium P. The image forming unit 19 forms the image on the printing medium P based on the print job generated by the processor 21.

The image forming unit 19 includes a plurality of mounting units 41, a plurality of process units 42, a plurality of exposure units 43, and a transfer mechanism 44. The image forming unit 19 includes the mounting unit 41 and the exposure unit 43 for each process unit 42. The process units 42, the mounting units 41, and the exposure units 43 have the same configurations, respectively. Therefore, one process unit 42, one mounting unit 41, and one exposure unit 43 will be described as an example.

Figure 2:
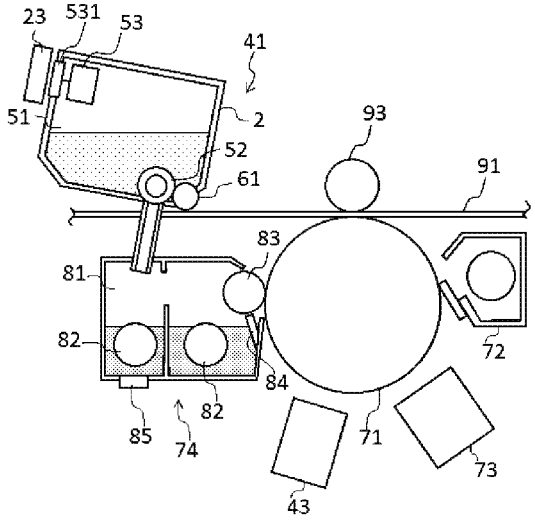
FIG. 2 is a diagram illustrating a configuration example of a part of the image forming unit.

FIG. 2 is a diagram illustrating an example of a configuration of a part of the image forming unit 19. First, the toner cartridge 2 mounted on the mounting unit 41 will be described. As illustrated in FIG. 2, the toner cartridge 2 includes a toner container 51, a toner feed mechanism 52, a memory 53, and a communication interface 531.

The toner container 51 is a container containing toner. The toner feed mechanism 52 is a mechanism that feeds out the toner in the toner container 51. The toner feed mechanism 52 is a screw that is provided in, for example, the toner container 51 and rotates to feed out the toner.

The memory 53 mounted on the toner cartridge 2 stores various control data in advance. The memory 53 is mounted on the toner cartridge 2. The processor 21 of the system controller 13 reads a value stored in the memory 53 via a main body-side communication interface 23 and the toner cartridge-side communication interface 531 to write the read value to the memory 22 or writes a value to the memory 53.

As illustrated in FIG. 2, each of the mounting units 41 is a module on which the toner cartridge 2 filled with toner is mounted. Each of the mounting units 41 includes a space where the toner cartridge 2 is mounted and a toner replenishing unit 61. Each of the mounting units 41 includes a communication interface through which the memory 53 of the toner cartridge 2 and the system controller 13 are connected.

The mounting unit 41 may include a lid that prevents the toner cartridge 2 from being unexpectedly drawn out to the front side of the image forming apparatus 1. When the lid is opened, the operation of the toner replenishing unit 61 may be forcibly stopped, and when the lid is closed, the processor 21 of the system controller 13 may read a value stored in the memory 53 via the main body-side communication interface 23 and the toner cartridge-side communication interface 531.

Once the main body-side communication interface 23 and the toner cartridge-side communication interface 531 enters a communicable state, the processor 21 of the system controller 13 may read a value stored in the memory 53.

The toner replenishing unit 61 drives the toner feed mechanism 52 of the toner cartridge 2 based on a control of the processor 21. When the toner cartridge 2 is mounted on the mounting unit 41, the toner replenishing unit 61 is connected to the toner feed mechanism 52 of the toner cartridge 2. The toner replenishing unit 61 is energized to axially rotate based on a control of the processor 21 and drives the toner feed mechanism 52 of the toner cartridge 2. The toner replenishing unit 61 drives the toner feed mechanism 52 such that the toner in the toner container 51 is supplied to the developing unit 74.

The processor 21 records a period of time for which the toner replenishing unit 61 drives the toner feed mechanism 52 in the memory 22. Here, the period of time for which the toner replenishing unit 61 drives the toner feed mechanism 52 that is recorded in the memory 22 by the processor 21 will be referred to as "replenishment amount". The amount of toner that is supplied by the toner feed mechanism 52 from the toner container 51 to the developing unit 74 is substantially proportional to the length of the time for which the toner replenishing unit 61 drives the toner feed mechanism 52 until the toner in the toner container 51 is reduced to some extent.

The process unit 42 is configured to form a toner image. For example, the process units 42 are provided corresponding to the kinds of toners. For example, the process units 42 correspond to color toners of cyan, magenta, yellow, black, and the like, respectively. Specifically, the toner cartridges 2 containing toners of different colors are connected to each of the process unit 42.

As illustrated in FIG. 2, the process unit 42 includes a photosensitive drum 71, a cleaner 72, an electrostatic charger 73, and the developing unit 74. The photosensitive drum 71 is a photoreceptor including: a cylindrical drum; and a photosensitive layer that is formed on an outer circumferential surface of the drum. The photosensitive drum 71 is rotated by a driving mechanism (not illustrated) at a constant speed.

The cleaner 72 removes toner remaining on the surface of the photosensitive drum 71. The electrostatic charger 73 uniformly charges a surface of the photosensitive drum 71. For example, the electrostatic charger 73 applies a voltage of a charging bias VC to the photosensitive drum 71 such that the photosensitive drum 71 is uniformly charged to a potential having a negative polarity.

The developing unit 74 attaches the toner to the photosensitive drum 71. The developing unit 74 includes, for example, a developer container 81, an agitating mechanism 82, a developing roller 83, a doctor blade 84, and an automatic toner control (ATC) sensor 85.

The developer container 81 contains a developer containing a toner and a carrier. The developer container 81 receives toner that is fed from the toner cartridge 2 by the toner feed mechanism 52. The carrier is contained in the developer container 81 during manufacturing of the developing unit 74.

The agitating mechanism 82 is driven by a motor (not illustrated) to agitate the toner and the carrier in the developer container 81.

The developing roller 83 carries the developer on the surface by rotating in the developer container 81 while being applied with a voltage of a developing bias VD.

The doctor blade 84 is a member disposed at a distance from the surface of the developing roller 83. The doctor blade 84 removes a part of the developer attached to the surface of the rotating developing roller 83. As a result, a layer of the developer having a thickness corresponding to the distance between the doctor blade 84 and the surface of the developing roller 83 is formed on the surface of the developing roller 83.

The ATC sensor 85 is, for example, a magnetic flux sensor that includes a coil and detects a voltage value generated in the coil. The detected voltage of the ATC sensor 85 changes depending on the density of a magnetic flux from the toner in the developer container 81. That is, the ATC sensor 85 detects a voltage corresponding to a ratio (simply referred to as "density") of the toner to the carrier in the developer container 81. The system controller 13 can determine the density in the developer container 81 based on the detected voltage of the ATC sensor 85. The ATC sensor 85 can sense only a part of a mixture including the toner and the carrier in the developer container 81. Therefore, it is more appropriate to provide the average detected voltage for the calculation of the density, the average detected voltage being obtained by acquiring the detected voltage of the ATC sensor 85 multiple times from the mixture that is agitated by the agitating mechanism 82 and moving.

The exposure unit 43 includes a plurality of light emitting elements. The exposure unit 43 forms a latent image on the photosensitive drum 71 by irradiating the charged photosensitive drum 71 with light from the light emitting elements. The light emitting element is, for example, a light emitting diode (LED) or a laser diode (LD). One light emitting element is configured to irradiate one point on the photosensitive drum 71 with light. The light emitting elements are arranged in a main scanning direction that is a direction parallel to a rotation axis of the photosensitive drum 71.

The exposure unit 43 forms a latent image corresponding to one line on the photosensitive drum 71 by irradiating the photosensitive drum 71 with light from the light emitting elements arranged in the main scanning direction. The exposure unit 43 forms a latent image corresponding to a plurality of lines by continuously irradiating the rotating photosensitive drum 71 with light.

In the above-described configuration, when the surface of the photosensitive drum 71 charged by the electrostatic charger 73 is irradiated with light from the exposure unit 43, an electrostatic latent image is formed. When the layer of the developer formed on the surface of the developing roller 83 approaches the surface of the photosensitive drum 71, the toner in the developer is attached to the latent image formed on the surface of the photosensitive drum 71. As a result, a toner image is formed on the surface of the photosensitive drum 71.

The transfer mechanism 44 is configured to transfer the toner image formed on the surface of the photosensitive drum 71 to the printing medium P.

As illustrated in FIGS. 1 and 2, the transfer mechanism 44 includes, for example, a primary transfer belt 91, a secondary transfer facing roller 92, a plurality of primary transfer rollers 93, and a secondary transfer roller 94.

The primary transfer belt 91 is an endless belt that is wound around the secondary transfer facing roller 92 and a plurality of winding rollers. In the primary transfer belt 91, an inner surface (inner circumferential surface) is in contact with the secondary transfer facing roller 92 and the winding rollers, and an outer surface (outer circumferential surface) faces the photosensitive drum 71 of the process unit 42.

The secondary transfer facing roller 92 is rotated by a motor (not illustrated). The secondary transfer facing roller 92 rotates to convey the primary transfer belt 91 in a conveying direction. The winding rollers are configured to be freely rotatable. The winding rollers rotate according to the movement of the primary transfer belt 91 by the secondary transfer facing roller 92.

The primary transfer rollers 93 are configured to bring the primary transfer belt 91 into contact with the photosensitive drum 71 of the process unit 42. The primary transfer rollers 93 are provided corresponding to the photosensitive drums 71 of the process units 42.

Specifically, the primary transfer rollers 93 are provided at positions where the primary transfer rollers 93 and the photosensitive drums 71 of the process units 42 corresponding thereto face each other with the primary transfer belt 91 interposed therebetween. The primary transfer roller 93 comes into contact with the inner circumferential surface side of the primary transfer belt 91 and displaces the primary transfer belt 91 to the photosensitive drum 71 side. As a result, the primary transfer roller 93 brings the outer circumferential surface of the primary transfer belt 91 into contact with the photosensitive drum 71.

The secondary transfer roller 94 is provided at a position where the secondary transfer roller 94 faces the primary transfer belt 91. The secondary transfer roller 94 comes into contact with the outer circumferential surface of the primary transfer belt 91 and applies a pressure. As a result, a transfer nip where the secondary transfer roller 94 and the outer circumferential surface of the primary transfer belt 91 are in close contact with each other is formed. When the printing medium P passes through the transfer nip, the secondary transfer roller 94 presses the printing medium P that is passing through the transfer nip against the outer circumferential surface of the primary transfer belt 91.

The secondary transfer roller 94 and the secondary transfer facing roller 92 rotate such that the printing medium P supplied through the paper feed conveyance path 31 is conveyed in a state where the printing medium P is interposed between the secondary transfer roller 94 and the secondary transfer facing roller 92. As a result, the printing medium P passes through the transfer nip.

In the above-described configuration, when the outer circumferential surface of the primary transfer belt 91 comes into contact with the photosensitive drum 71, the toner image formed on the surface of the photosensitive drum is transferred to the outer circumferential surface of the primary transfer belt 91. As illustrated in FIG. 1, when the image forming unit 19 includes a plurality of process units 42, the primary transfer belt 91 receives the toner image from the photosensitive drums 71 of the process units 42. The toner image transferred to the outer circumferential surface of the primary transfer belt 91 is conveyed by the primary transfer belt 91 up to the transfer nip where the secondary transfer roller 94 and the outer circumferential surface of the primary transfer belt 91 are in close contact with each other. When the printing medium P is present in the transfer nip, the toner image transferred to the outer circumferential surface of the primary transfer belt 91 is transferred to the printing medium P in the transfer nip.

The fixing unit 20 fixes the toner image by fusing the toner transferred to the printing medium P. The fixing unit 20 operates based on a control of the system controller 13. The fixing unit 20 includes: a heating member that applies heat to the printing medium P; and a pressurizing member that applies pressure to the printing medium P. For example, the heating member is, for example, a heating roller 95. The pressurizing member is, for example, a press roller 96.

The heating roller 95 is a fixing rotor that is rotated by a motor (not illustrated). The heating roller 95 includes: a hollow core that is formed of metal; and an elastic layer that is formed on an outer circumference of the core. The heating roller 95 is heated to a high temperature by a heater disposed inside the core formed in a hollow shape. The heater is, for example, a halogen heater. The heater may be an induction heating (IH) heater that heats the core using electromagnetic induction.

The press roller 96 is provided at a position where the press roller 96 faces the heating roller 95. The press roller 96 includes: a core that is formed of metal; and an elastic layer that is formed on an outer circumference of the core. The press roller 96 applies pressure to the heating roller 95 using a stress applied from a tension member (not illustrated). By the press roller 96 applying pressure to the heating roller 95, a nip (fixing nip) where the press roller 96 and the heating roller 95 are in close contact with each other is formed. The press roller 96 is rotated by a motor (not illustrated). The press roller 96 rotates such that the printing medium P entering the fixing nip is moved and is pressed against the heating roller 95.

With the above-described configuration, the heating roller 95 and the press roller 96 apply heat and pressure to the printing medium P that is passing through the fixing nip. As a result, the toner image is fixed to the printing medium P that passes the fixing nip. The printing medium P that passes the fixing nip is introduced into the paper discharge conveyance path 32 and is discharged to the outside of the housing 11. The fixing unit 20 is not limited to the above-described configuration. The fixing unit 20 may be configured as an on-demand type in which heat is applied to the printing medium P to which the toner image is transferred through a film-shaped member such that the toner is fused and fixed.

The memory 53 mounted on the toner cartridge 2 stores various control data in advance. The memory 53 is mounted on the toner cartridge 2. The processor 21 of the system controller 13 reads a value stored in the memory 53 via the main body-side communication interface 23 and the toner cartridge-side communication interface 531 to write the read value to the memory 22 or writes a value to the memory 53.

The control data stored in the memory 53 is, for example, an identification code, an inner capacity, a density equivalent value, a conversion reference, an appropriate charging bias VCR, or an appropriate developing bias VDR.

The identification code represents the kind, model number, and the like of the toner cartridge 2. When the toner cartridge 2 is mounted on the mounting unit 41, the processor 21 of the system controller 13 reads an identification code stored in the memory 53 via the main body-side communication interface 23 and the toner cartridge-side communication interface 531. When the identification code that is read at this time is the same as the identification code written in the memory 22 in advance, it is determined that the toner cartridge 2 that is the same as the previously mounted toner cartridge is also mounted at this time. When the identification code that is read at this time is different from the identification code written in the memory 22 in advance, it is determined that the toner cartridge 2 that is different from the previously mounted toner cartridge is mounted at this time.

The inner capacity refers to a value representing a time as a measure for determining an increased replenishment amount that is obtained when the toner in the toner cartridge 2 is used up for the replenishment. When the toner replenishing unit 61 drives the toner feed mechanism 52 for a period of time corresponding to the inner capacity in a state where the toner cartridge 2 is not detached from the mounting unit 41, the processor 21 of the system controller 13 causes the display unit 14 to display a message promoting the replacement of the toner cartridge 2.

The density equivalent value refers to a value corresponding to the detected voltage of the ATC sensor 85 of the developing unit 74, the detected voltage being stored in the memory 53 before the toner cartridge 2 is mounted on the mounting unit 41. When the toner cartridge 2 is mounted on the mounting unit 41, the processor 21 of the system controller 13 writes a value to the memory 53 as the density equivalent value via the main body-side communication interface 23 and the toner cartridge-side communication interface 531, the value corresponding to the detected voltage of the ATC sensor 85 of the developing unit 74 when the toner cartridge 2 is mounted on the mounting unit 41.

The conversion reference is a table for converting the density equivalent value into an estimated amount. The conversion reference may be configured as a table where values are associated with each other, or may be a value representing a proportionality coefficient between the density equivalent value and the estimated amount. The density equivalent value to be converted into the estimated amount based on the conversion reference refers to a value corresponding to the detected voltage of the ATC sensor 85 of the developing unit 74 when the toner cartridge 2 is mounted on the mounting unit 41.

The estimated amount refers to a value representing a time as a measure for determining an increased replenishment amount that is obtained when all the toner in the developing unit is the toner replenished from the toner cartridge 2 mounted on the mounting unit 41.

The appropriate charging bias VCR refers to a value representing a voltage value of a charging bias appropriate for the toner in the toner cartridge 2. The appropriate developing bias VDR refers to a value representing a voltage value of a developing bias appropriate for the toner in the toner cartridge 2.

The processor 21 of the system controller 13 sets the charging bias VC that is applied by the electrostatic charger 73 based on the appropriate charging bias VCR until the replenishment amount reaches the estimated amount, the appropriate charging bias VCR being obtained from the formula VC=VCA−((VCA−VCR)/estimated amount)×(replenishment amount). Here, VCA refers to a charging bias that is set before the present toner cartridge 2 is mounted on the mounting unit 41.

The processor 21 of the system controller 13 sets the developing bias VD based on the appropriate developing bias VDR until the replenishment amount reaches the estimated amount, the appropriate developing bias VDR being obtained from the formula VD=VDA−((VDA−VDR)/estimated amount)×(replenishment amount). Here, VDA refers to a developing bias that is set before the present toner cartridge 2 is mounted on the mounting unit 41.

The control of the image forming apparatus 1 by the system controller 13 will be described.

Figure 3:
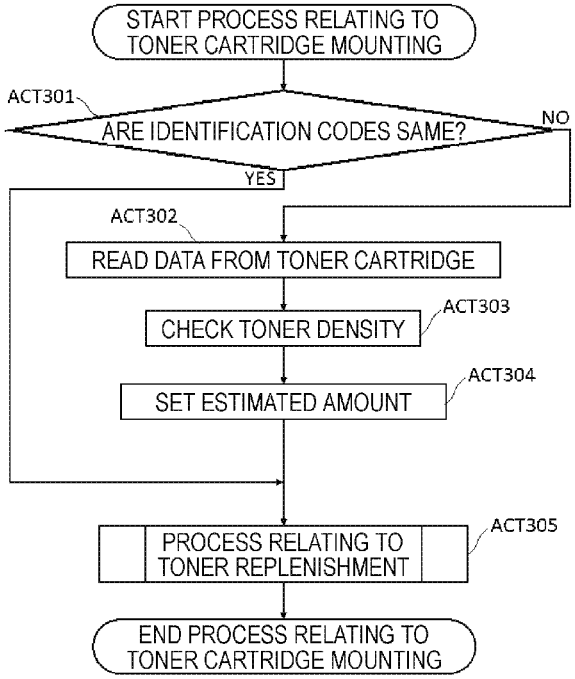
FIG. 3 is a diagram illustrating an example of an operation of the image forming apparatus.

FIG. 3 is a flowchart illustrating a process relating to the toner cartridge mounting by the system controller 13.

A trigger for starting the process may be, for example, the closing of the lid of the mounting unit 41. The trigger for starting the process may be, for example, a communicable state of the main body-side communication interface 23 and the toner cartridge-side communication interface 531.

The trigger for starting the process may be another condition.

The processor 21 determines whether the identification code that is read at this time is the same as the identification code that is written in the memory 22 in advance (ACT 301).

When the processor 21 determines that the identification code that is read at this time is the same as the identification code that is written in the memory 22 in advance (ACT 301, YES), the processor 21 proceeds to a process of ACT 305.

When the processor 21 determines that the identification code that is read at this time is different from the identification code that is written in the memory 22 in advance (ACT 301, NO), the processor 21 reads data such as the inner capacity, the density equivalent value, the conversion reference, the appropriate charging bias VCR, or the appropriate developing bias VDR from the memory 53 of the toner cartridge 2, and writes the read data to the memory 22 (ACT 302).

The processor 21 checks the density in the developer container 81 based on the detected voltage of the ATC sensor 85 (ACT 303).

The processor 21 acquires the estimated amount by collating the detected voltage of the ATC sensor 85 with the conversion reference, and the records the acquired estimated amount in the memory 22 (ACT 304). The processor 21 executes a process relating to the toner replenishment in order to appropriately set the density in the developer container 81 (ACT 305), and ends the process relating to the toner cartridge mounting.

Figure 4:
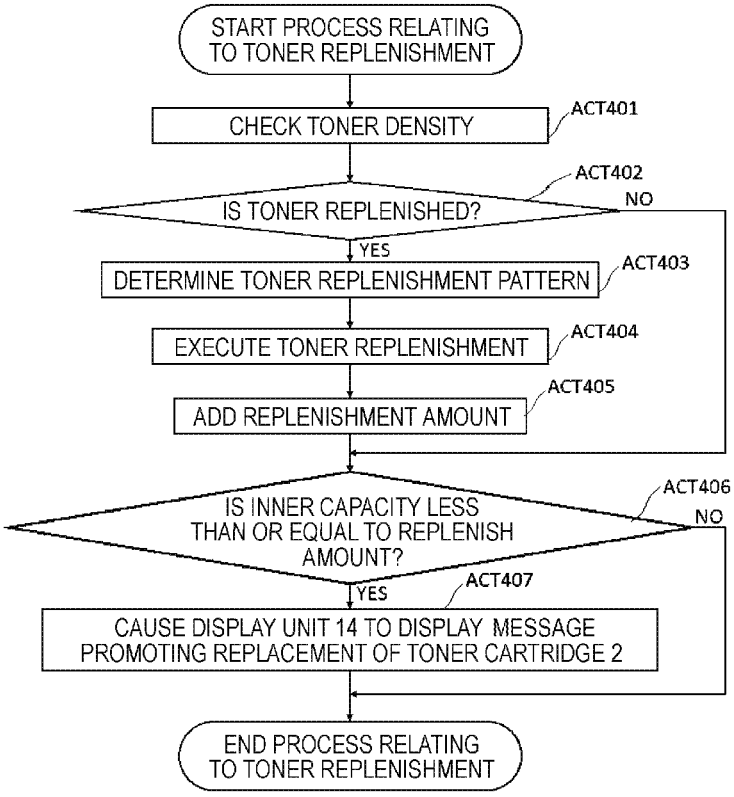
FIG. 4 is a diagram illustrating an example of an operation of the image forming apparatus.

FIG. 4 is a flowchart illustrating the process relating to the toner replenishment by the system controller 13.

The processor 21 checks the density in the developer container 81 based on the detected voltage of the ATC sensor 85 (ACT 401).

The processor 21 determines whether to execute the toner replenishment (ACT 402). The processor 21 determines whether to execute the toner replenishment by collating the density in the developer container 81 checked in ACT 401 with preset criteria.

When the processor 21 determines that the toner replenishment is not to be executed (ACT 402, NO), the processor 21 proceeds a process of ACT 406.

When the processor 21 determines that the toner replenishment is to be executed (ACT 402, YES), the processor determines a replenishment pattern (ACT 403). The replenishment pattern is, for example, a period of time for which the toner replenishing unit 61 drives the toner feed mechanism 52.

The replenishment pattern is, for example, a maximum target value of the detected voltage of the ATC sensor 85 that can be reached along with an increase in the density in the developer container 81 by causing the toner replenishing unit 61 to drive the toner feed mechanism 52 without predetermining the driving time.

The processor 21 executes a toner replenishment operation by causing the toner replenishing unit 61 to drive the toner feed mechanism 52 with the determined replenishment pattern (ACT 404).

The processor 21 overwrites a value as the replenishment amount of the memory 22, the value being obtained by adding the time corresponding to the replenishment pattern determined in ACT 15 to the replenishment amount stored in the memory 22 (ACT 405). The processor 21 also overwrites the replenishment amount overwritten to the memory 22 to the memory 53 mounted on the toner cartridge 2.

The processor 21 determines whether the replenishment amount of the memory 22 is more than or equal to the inner capacity stored in the memory 22 (ACT 406).

When the processor 21 determines that the replenishment amount of the memory 22 is not more than or equal to the inner capacity stored in the memory 22 (ACT 406, NO), the processor 21 ends the process relating to the toner replenishment.

When the processor 21 determines that the replenishment amount of the memory 22 is more than or equal to the inner capacity stored in the memory 22 (ACT 406, YES), the processor 21 causes the display unit 14 to display a message promoting the replacement of the toner cartridge 2 (ACT 407) and ends the process relating to the toner replenishment.

Figure 5:
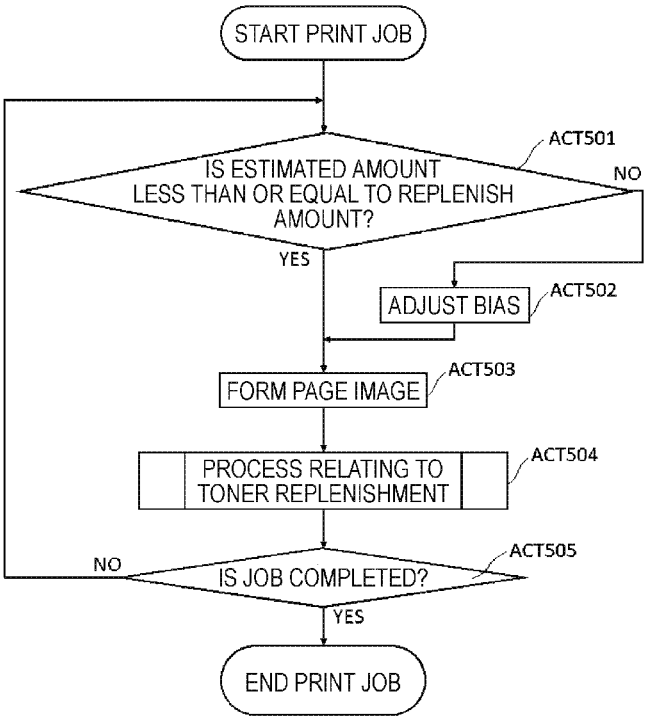
FIG. 5 is a diagram illustrating an example of an operation of the image forming apparatus.

FIG. 5 is a flowchart illustrating a process relating to a print job by the system controller 13.

The processor 21 determines whether the replenishment amount of the memory 22 is more than or equal to the estimated amount stored in the memory 22 (ACT 501).

When the processor 21 determines that the replenishment amount of the memory 22 is more than or equal to the estimated amount stored in the memory 22 (ACT 501, YES), the processor 21 proceeds to a process of ACT 503.

When the processor 21 determines that the replenishment amount of the memory 22 is not more than or equal to the estimated amount stored in the memory 22 (ACT 501, NO), the processor acquires the appropriate charging bias VCR or the appropriate developing bias VDR based on the current replenishment amount and stores the acquired appropriate charging bias VCR or the acquired appropriate developing bias VDR in the memory 22 (ACT 502). The processor 21 controls a voltage of the charging bias VC that is applied by the electrostatic charger 73 based on the appropriate charging bias VCR. The processor 21 controls a voltage of the developing bias VD that is applied by the developing roller 83 based on the appropriate developing bias VDR.

The processor 21 cause the image forming unit 19 to form an image corresponding to one page in the print job on the printing medium P (ACT 503).

The processor 21 executes the processor relating to the toner replenishment in order to appropriately set the density in the developer container 81 after the image forming unit 19 forms the image corresponding to one page on the printing medium P (ACT 504).

The processor 21 determines whether a remaining image in the print job that is to be formed on the printing medium P is still present (ACT 505).

When the processor 21 determines that a remaining image in the print job that is to be formed on the printing medium P is still present (ACT 505, NO), the processor 21 executes ACT 501 on an image corresponding to the next single page.

When the processor 21 determines that the formation of a group of images in the print job on the printing medium P ends (ACT 505, YES), the processor 21 ends the process relating to the print job.

Through ACT 501 and ACT 502, the processor 21 reduces the use frequency of the appropriate charging bias VCR of the toner or the appropriate developing bias VDR that is stored in the developer container 81 before the current toner cartridge 2 is mounted on the mounting unit 41 by the replenishment amount increased through the process relating to the toner replenishment, and increases the use frequency of the appropriate charging bias VCR or the appropriate developing bias VDR of the toner of the current toner cartridge 2. The processor 21 gradually changes the appropriate charging bias VCR or the appropriate developing bias VDR through ACT 501 and ACT 502 whenever an image is formed. Therefore, an abrupt large change in the image quality of the toner image before and after the replacement is avoidable even when the toner cartridge is replaced.

In FIG. 3, when the processor 21 determines that the identification code that is read at this time from the memory 53 of the toner cartridge 2 is different from the identification code that is written in the memory 22 in advance, the processor 21 writes the data read from the memory 53 of the toner cartridge 2 to the memory 22. However, when the replenishment amount that is read at this time from the memory 53 of the toner cartridge 2 is different from the replenishment amount that is stored in the memory 22, the processor 21 may write the data read from the memory 53 of the toner cartridge 2 to the memory 22.

The functions described in the respective embodiments are not limited to being configured using hardware, and can also be implemented using software by causing a computer to read programs storing the respective functions. The respective functions may be configured by appropriately selecting either software or hardware.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming component configured to form a toner image using a first toner supplied to the image forming component with a first process bias VR;

a density sensor configured to detect a density of toner in the image forming component;

a toner cartridge containing a second toner and including a memory that stores data representing a process bias VA appropriate for the second toner;

a mounting structure on which the toner cartridge is mounted;

a toner replenishing component configured to replenish the image forming component with the second toner from the toner cartridge mounted on the mounting structure based on the density; and a processor configured to convert a density detected by the density sensor when the toner cartridge is mounted on the mounting unit into an estimated amount, and set the image forming component to a process bias V until the image forming component is replenished with the second toner by the estimated amount after the toner cartridge is mounted on the mounting structure, the process bias V obtained from formula:

$V=VA-((VA-VR)/\text{the estimated amount})\times(\text{an amount of the second toner with which the image forming component is replenished after the toner cartridge is mounted on the mounting structure})$.

2. The apparatus according to claim 1, wherein the processor converts a density into an estimated amount, the density being detected by the density sensor before the toner replenishing component replenishes the image forming component with the second toner from the toner cartridge.

3. The apparatus according to claim 1, further comprising:

a storage component configured to store an identification code that is read by the processor from the toner cartridge mounted on the mounting structure, wherein when the identification code stored in the storage component is different from the identification code read from the toner cartridge, the processor converts a density detected by the density sensor when the toner cartridge is mounted on the mounting structure into an estimated amount; and sets the image forming component to the process bias V until the image forming component is replenished with the second toner by the estimated amount after the toner cartridge is mounted on the mounting structure, the process bias V being obtained from formula:

$$V=VA-((VA-VR)/\text{the estimated amount})\times(\text{an amount of the second toner with which the image forming component is replenished after the toner cartridge is mounted on the mounting structure}).$$

4. The apparatus according to claim 1, wherein the image forming component comprises a photoreceptor configured to carry the toner image, and the process bias is a charging bias applied to charge the photoreceptor.

5. The apparatus according to claim 1, wherein the image forming component further includes a developing unit configured to develop the toner image, the process bias is a developing bias applied to the developing component to develop the toner image.

6. The apparatus according to claim 1, wherein the first toner is different from the second toner.

7. The apparatus according to claim 1, wherein the first toner comprises a toner made by a first manufacturer and the second toner comprises a toner made by a second manufacturer different from the first manufacturer.

8. The apparatus according to claim 1, further comprising:

a display configured to indicate a remaining amount of first toner.

9. A method for image forming apparatus, comprising:

forming a toner image using a first toner supplied to an image forming component with a first process bias VR;

detecting a density of toner in the image forming component using a density sensor;

replenishing the image forming component with a second toner from a toner cartridge mounted on a mounting structure based on the density, the second toner having a process bias VA associated therewith;

converting a density detected by the density sensor when the toner cartridge is mounted on the mounting unit into an estimated amount; and setting the image forming component to a process bias V until the image forming component is replenished with the second toner by the estimated amount after the toner cartridge is mounted on the mounting structure, the process bias V obtained from formula:

$$V=VA-((VA-VR)/\text{the estimated amount})\times(\text{an amount of the second toner with which the image forming component is replenished after the toner cartridge is mounted on the mounting structure}).$$

10. The method according to claim 9, further comprising:

converting a density into an estimated amount, the density being detected by the density sensor before the toner replenishing component replenishes the image forming component with the second toner from the toner cartridge.

11. The method according to claim 9, further comprising:

storing an identification code that is read by a processor from the toner cartridge mounted on the mounting structure; and when the identification code stored is different from the identification code read from the toner cartridge, converting a density detected by the density sensor when the toner cartridge is mounted on the mounting structure into an estimated amount; and setting the image forming component to the process bias V until the image forming component is replenished with the second toner by the estimated amount after the toner cartridge is mounted on the mounting structure, the process bias V being obtained from formula:

$$V=VA-((VA-VR)/\text{the estimated amount})\times(\text{an amount of the second toner with which the image forming component is replenished after the toner cartridge is mounted on the mounting structure}).$$

12. The method according to claim 9, wherein the image forming component comprises a photoreceptor configured to carry the toner image, and the process bias is a charging bias applied to charge the photoreceptor.

13. The method according to claim 9, wherein the image forming component further includes a developing unit configured to develop the toner image, the process bias is a developing bias applied to the developing component to develop the toner image.

14. The method according to claim 9, wherein the first toner is different from the second toner.

15. The method according to claim 9, wherein the first toner comprises a toner made by a first manufacturer and the second toner comprises a toner made by a second manufacturer different from the first manufacturer.

16. The method according to claim 9, further comprising:

displaying a remaining amount of first toner.

* * * * *